US007748371B1

(12) United States Patent
Doty

(10) Patent No.: US 7,748,371 B1
(45) Date of Patent: Jul. 6, 2010

(54) ARROW REST AND LAUNCHER FOR AN ARCHERY BOW

(76) Inventor: Michael Doty, P.O. Box 935, Thompson Falls, MT (US) 59873

( * ) Notice: Subject to any disclaimer, the term of this patent is extended or adjusted under 35 U.S.C. 154(b) by 419 days.

(21) Appl. No.: 11/649,071

(22) Filed: Jan. 3, 2007

Related U.S. Application Data

(60) Provisional application No. 60/755,347, filed on Dec. 30, 2005.

(51) Int. Cl.
*F41B 5/22* (2006.01)

(52) U.S. Cl. ..... 124/44.5

(58) Field of Classification Search ..... 124/44.5; 24/115 H, 115 K, 135 R, 135 N
See application file for complete search history.

(56) References Cited

U.S. PATENT DOCUMENTS 264,298 A * 9/1882 Johnson ..... 439/781
299,199 A * 5/1884 Brown ..... 16/205
1,262,951 A * 4/1918 Houff ..... 24/135 R
4,324,221 A * 4/1982 Peck ..... 124/24.1
4,803,971 A * 2/1989 Fletcher ..... 124/44.5
5,261,383 A * 11/1993 Halamay ..... 124/44.5
5,327,877 A * 7/1994 Shaw, III ..... 124/24.1
5,419,303 A * 5/1995 Stewart ..... 124/44.5
5,460,151 A * 10/1995 Hamilton et al. ..... 124/44.5
5,960,779 A 10/1999 Jessee et al.
6,044,832 A * 4/2000 Piersons, Jr. ..... 124/44.5
6,202,635 B1 * 3/2001 Evans ..... 124/44.5
6,739,321 B1 5/2004 Puchlerz

* cited by examiner

*Primary Examiner*—John Ricci
(74) *Attorney, Agent, or Firm*—Jean Kyle

(57) ABSTRACT

An arrow rest having a pivoting lever arm attached to a body allows accurate and precise adjustment of the arrow's flight path. The pivoting lever arm is threadedly attached to the body making adjustments to center quick and easy. The arrow rest is actuated by a cord attached to the rest by a set screw allowing the user to adjust the length of the cord readily.

8 Claims, 6 Drawing Sheets

ARROW REST AND LAUNCHER FOR AN ARCHERY BOW

CROSS-REFERENCE TO RELATED APPLICATIONS

This application claims the benefits of U.S. Provisional Application No. 60/755,347, filed Dec. 30, 2005, the disclosure of which is hereby incorporated by reference in its entirety including all figures, tables and drawings.

BACKGROUND OF THE INVENTION

An arrow rest mounts to the bow and has a means to cradle or support the arrow until it is shot from the bow. The means to support or cradle the arrow are often designed to move away from the arrow before being contacted by the fletching of the arrow so as not to interfere with the flight of the arrow.

One method used to remove the launcher of the rest from the flight path of the arrow is to employ a spring to bias the launcher in an upward position. The launcher moves through the spring downward to accommodate the normal bending of the arrow as it is shot. The launcher might also be moved down if the fletching strikes it. This popular style of arrow rest is commonly referred to as a "shoot-through" rest. One drawback to this style of rest is that although the launcher yields to various degrees as the arrow passes, even light contact between the arrow fletching and arrow rest can adversely influence the arrow's flight path resulting in poor and/or inconsistent accuracy.

Another popular style of arrow rest is a "drop-away" or "fall-away" rest (U.S. Pat. Nos. 5,960,779 and 6,739,321 B1). The launcher on these rests rises on a pivot as the arrow is drawn back into the ready to shoot position to support the arrow and then falls away, out of the path of the arrow as the arrow is fired. The launcher is biased to be down and away from the arrow until the launcher is raised into shooting position to support the arrow by a means connected to a moving part of the bow. Generally, a cord or other mechanical means is used to raise the launcher by linking the launcher to a cable or cable guide that moves along with the cables of the bow. One end of the cord is tied to a moving part of the bow, the cable or cable guide, and the other end of the cord is tied to a portion of the arrow rest. The cord can also be passed through a hole in the rest and a knot can be tied to prevent the cord from passing back through the hole. Alternatively, the cord is passed through a hole in the rest and a band is crimped onto the cord to prevent the cord from passing back through the hole. Considerable trial and error is required to properly adjust the length of the cord to insure proper and complete release of the arrow.

The launcher is adjusted on the bow to insure the arrow is held in line with the travel of the bowstring path as the bowstring propels the arrow. The launcher is moved left or right in a horizontal plane perpendicular to the bowstring to "center" the shot. If adjustment means are not precisely manufactured or are poorly designed such adjustment can result in the loosening the rest or the launcher being moved not just right or left but in two planes. The launcher must also be adjusted vertically to likewise provide more accurate arrow flight by directing the propelling thrust of the bow string through the center of the arrow however it is best to make each adjustment separately.

A minimum amount of free-play in the bearing or pivot mechanism supporting the launcher is desirable in an arrow rest. When using an axle to rotate a single bushing or multiple bushings (or bearings), precise manufacturing is required or excessive clearance will be created and there will be undesired movement in the wrong planes. Further, moving parts can have insufficient clearance and movement could be hampered. Even if the parts are manufactured to a tight tolerance, the anodized finish common on aluminum parts is inexact and adds to the dimension of the parts. Therefore, a reliable, sturdy, and durable movement mechanism is a necessity for a high performance arrow rest.

There are many styles and models of arrow rests with launchers. Errors and defects in design however can lead to inaccuracies in the operation of the rest and ultimately release of the arrow. A need remains for an arrow rest and launcher that is simple to use and manufacture yet can be reliably adjusted with precision and accuracy.

All patents, patent applications, provisional patent applications and publications referred to or cited herein, are incorporated by reference in their entirety to the extent they are not inconsistent with the explicit teachings of the specification.

SUMMARY OF THE INVENTION

The subject invention involves an arrow rest that is easily and accurately adjusted for precision arrow release. Easy adjustment of the cord attached to the launcher arm is facilitated by a clamping screw. Accurate positioning and adjustment of the launcher is accomplished by moving the launcher spool along a threaded stud. Micrometer-style movement is provided which is extremely reliable and highly predictable. Movement can be measured while adjusting the launcher with accuracy approaching that of some measuring tools. The adjustment means affects only the center-shot with no chance of affecting other adjustments. The rest is assembled to provide the user full control of the pivot and bearing clearance. Thus, compensation is provided for normal wear and manufacturing differences.

DETAILED DESCRIPTION OF THE INVENTION

The invention involves a "fall-away" style arrow rest that is simple in construction yet can be accurately and precisely adjusted. The exemplified embodiments show a right hand model of the subject rest and launcher. A left hand model however is merely a mirror image of the right hand model, and it is intended that such a model be covered by the subject disclosure.

One advantage of the rest of the subject invention is that it requires fewer parts, yet provides a fully functioning contemporary arrow rest considered to be state of the art. Arrow rests must be adjustable, in order to fit a variety of bows with different dimensions, and to fit the style of the individual archer. Normally, this requires a multitude of parts that are costly to manufacture and provide more chances of part breakage or loosening of parts. The subject rest is simple in construction offering precise adjustability.

Micro-drives are often used to make fine adjustments. A micro-drive uses a lead screw to move one part in relation to another which is more accurate than simply loosening two parts and moving them arbitrarily. It is also common to have a primary means to secure adjoining parts to one another after adjustment is made. The subject rest employs micro-drives to insure accuracy.

Figure 1:
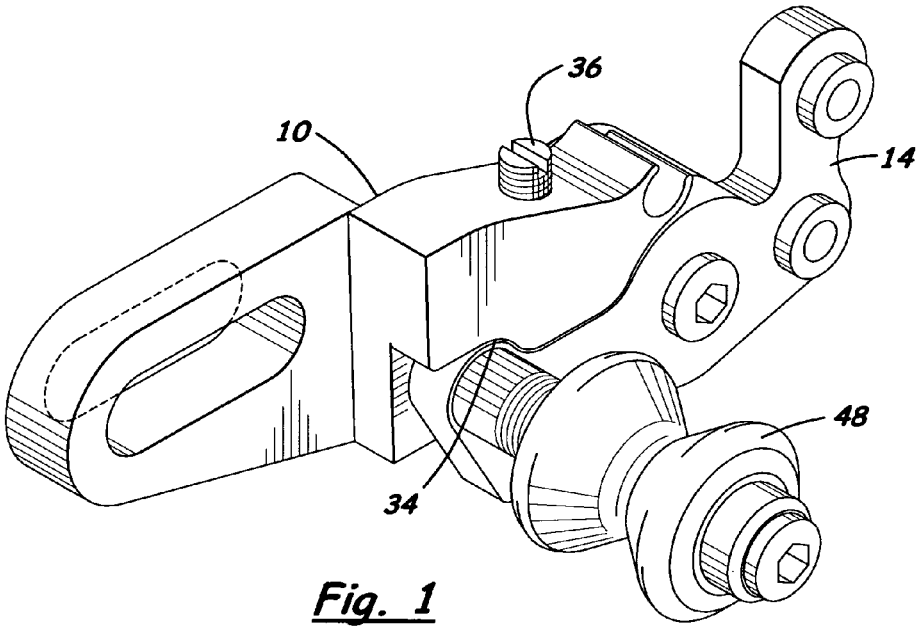
FIG. 1 is a perspective view of a preferred embodiment of the arrow rest of the subject invention.
Figure 3:
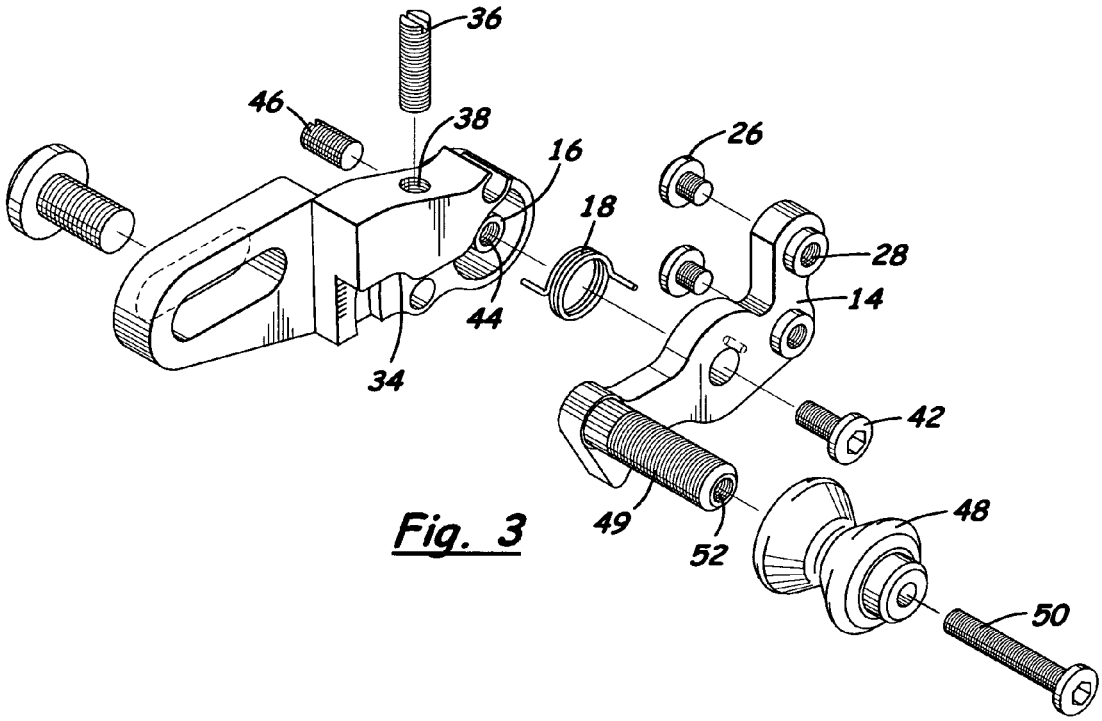
FIG. 3 is an exploded view of a preferred embodiment of the arrow rest of the subject invention.
Figure 5:
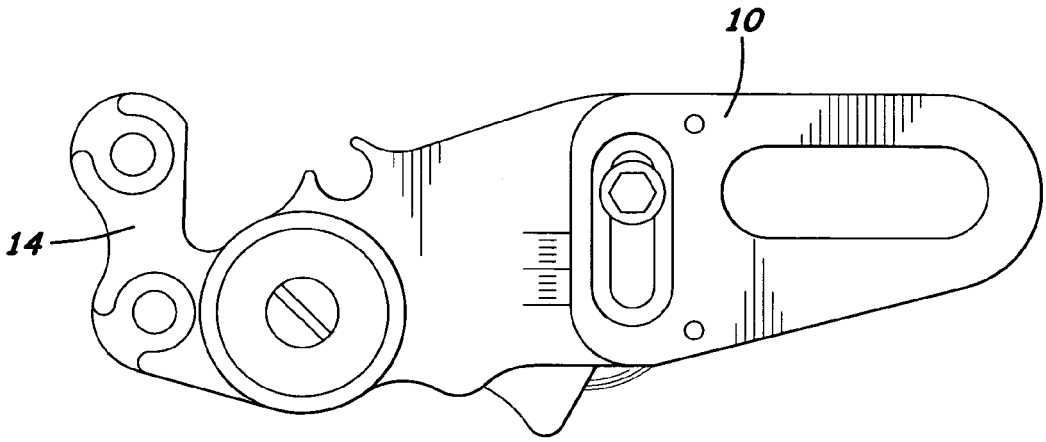
FIG. 5 is a right side view of another preferred embodiment of the arrow rest of the subject invention.

A preferred embodiment of the arrow rest of the subject invention is shown generally in FIG. 1 and has a main body 10 to mount the rest to the bow 12. In this embodiment, the rest is mounted to the bow with a screw that protrudes through a slot in the body 10 and is anchored to the bow riser. In the embodiment shown in FIG. 1, the body of the subject rest is one piece. Alternatively, the body is manufactured from two or more pieces and fastened together to form essentially the same structure (FIG. 5). A lever 14 pivots around a post 16 incorporated into the body. The post can be incorporated into either the body or the lever, with a mating bore on either the lever or body. The lever is biased with spring 18 (FIG. 3). Generally, it is biased so the arrow rest launcher is in the lowest position.

Figure 2:
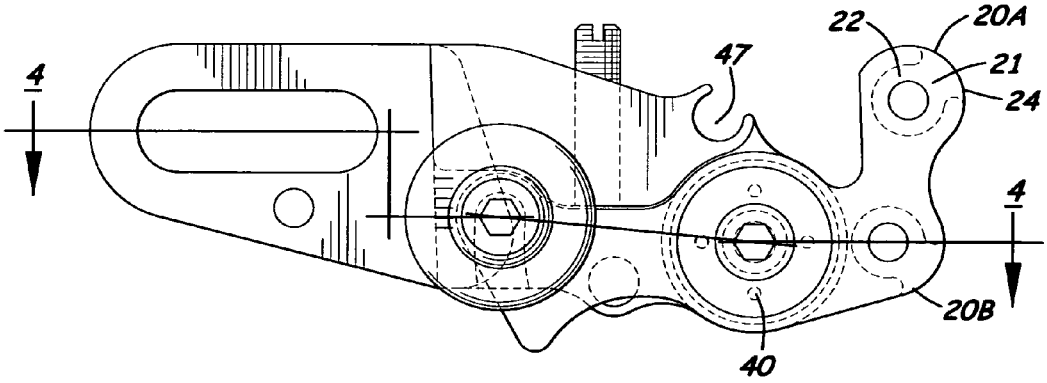
FIG. 2 is a left side view of a preferred embodiment of the arrow rest of the subject invention.

In a preferred embodiment the biasing spring 18 is a torsion spring although an extension spring or other biasing means can also be used. There can be multiple spring anchoring points 40 to receive one end of the spring in order to provide for spring tension adjustments. Also, a single anchor can be used. Alternately, the multiple anchor points can be embodied in the lever 14 (FIG. 2). Additionally, there can be a single anchor point in the body and lever, or multiple anchor points in the body and lever.

Figure 4:
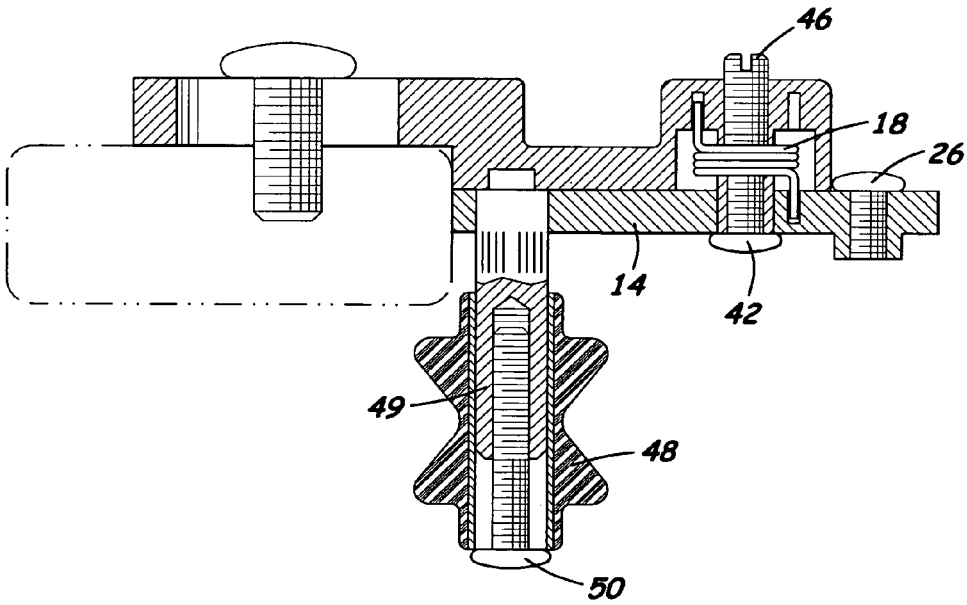
FIG. 4 is a top cross-sectional view along line 4 in FIG. 2 of a preferred embodiment of the arrow rest of the subject invention.

The lever 14 is connected to the body by a screw 42 (FIG. 3). The connecting screw threads into a threaded bore in the body 44. A locking screw 46 can be used in the opposite end of the threaded bore to oppose the connecting screw (FIG. 4). The locking screw provides depth adjustment of the connecting screw 42 so bearing clearance can be adjusted to remove excessive clearance and yet provide free movement. Further, the locking screw is useful in keeping the connecting screw from rotating so that adjustment is not lost. This connection method provides control of movement in both the radial and axial planes. The connecting screw controls the clearance in the axial plane, which more effectively controls undesired movement of the launcher. A proper amount of clearance in the pivot bearing is provided which is easily and precisely adjusted when assembled at the factory or by the end user. Thus, this connection compensates for normal wear and manufacturing differences and the user has full control of pivot and bearing clearance.

As the bow is drawn, the pull cord 30 pulls on the lever 14 and rotates the lever to an upright position (FIGS. 7-10). The launcher spool 48 is attached to the lever and is raised also. When the bow is fired, the pull cord slacks and the spring bias rotates the lever and launcher spool down and out of the way of the arrow. When the bow is fired, the lever can contact the body, in a particularly preferred embodiment, a bumper 47 of, for example, rubber or other soft material, is placed between the two pieces to reduce the noise of contact.

Figure 6:
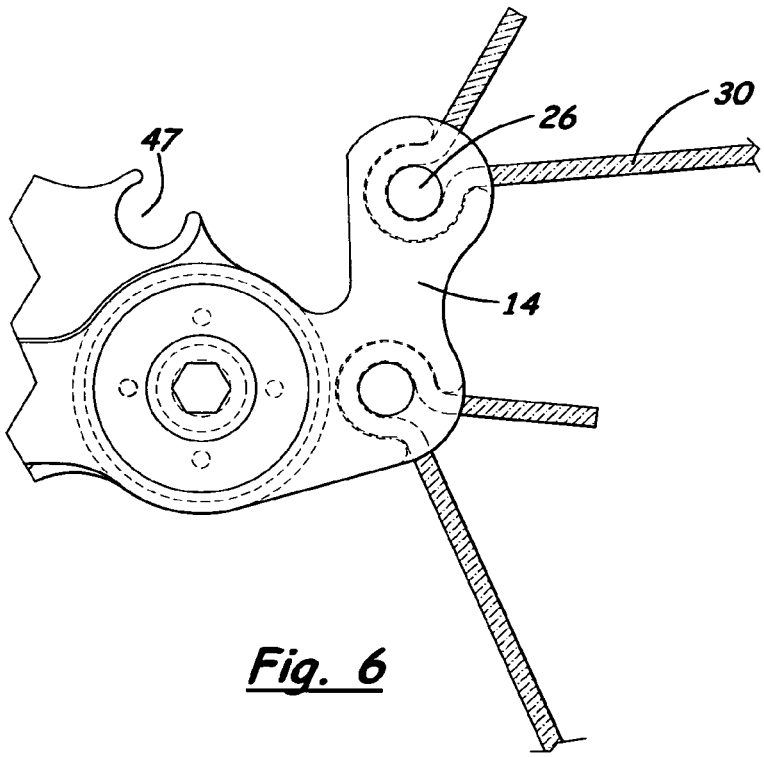
FIG. 6 is an enlarged view of a cord attached to a preferred embodiment of a cord attachment point of the arrow rest of the subject invention.

One or more cords are attached to the lever arm 14 to pivot the arm as the bow is drawn. The cord attachment points on the rest of the subject invention make adjustment of these cords quick and simple. Cord attachment points 20 are a cavity 21 in the lever arm with a sidewall 22 and an opening 24 in the sidewall sufficient for the cord to pass through (FIG. 6). A clamping screw 26 is threaded into a threaded bore 28 (FIG. 3) located essentially in the center of the cavity, and the cord 30 is wrapped around the screw (FIG. 6). The screw is tightened down to hold the cord, and the sidewall and screw head securely retain the cord. This system is simple and allows cord length to be adjusted easily. The cavity can be oriented in any suitable plane on the arrow rest part, and still fall within the scope of the invention.

In a preferred embodiment, the lever arm 14 has two cord attachment points 20A and 20B. Alternate attachment points on the arrow rest accommodate various bows where the cord may be pulled from different angles. Pull cords can be attached to either the cable on the bow or the cable shield.

A surface 34 is contoured to make contact with the lever when it is in the upright position and limits the upward travel (FIG. 1). In a preferred embodiment, the archer can further limit upward travel of the lever by adjusting a stop screw 36. The stop screw 36 engages a threaded bore 38 in the body and is used to adjust the upward rotational travel of the lever arm.

The launcher spool 48 is threaded onto a threaded stud 49 (FIG. 3). The threaded stud can be integral with the lever 14 or a separate component combined with the lever. The launcher spool is adjusted by rotating it on the threaded stud either in a clockwise or counterclockwise direction. A locking screw 50 that threads into a threaded bore 52 in the center of the stud 49 is tightened so the launcher spool is secured onto the stud. With machine cut threads the distance of a single turn or a fraction of a turn can be calculated to move the component incrementally. For example, if there are 20 threads per inch, one full turn equals 0.050" travel. By placing a mark on the stud 49, and annular marks on the launcher spool, fractions of a turn can be discerned. If there are 10 annular marks or divisions, each fraction of a turn that travels from one mark to the next is a tenth of 0.050" travel, or 0.005". Depending on the actual thread pitch employed, and the number of annular divisions, the actual travel of a full turn or turn between marks will vary. This known method is used in the precision measuring tools micrometers. Being able to precisely move the adjustments in small increments is useful for obtaining the best center-shot adjustment for a particular bow, arrow spine (stiffness) and shooting technique. In addition to providing a very accurate and sure way to adjust the launcher position, it is also provides an easier and simpler method of adjustment. The subject disclosure describes a simplified means to adjust center-shot on an arrow rest. This simplified means is accurate and provides a reliable method to make adjustments with predicable movement. It involves a micrometer style movement that also can measure movement while adjusting, with accuracy approaching that of some measuring tools. These adjustment means affect only the center-shot, other adjustments are not affected.

Figure 7:
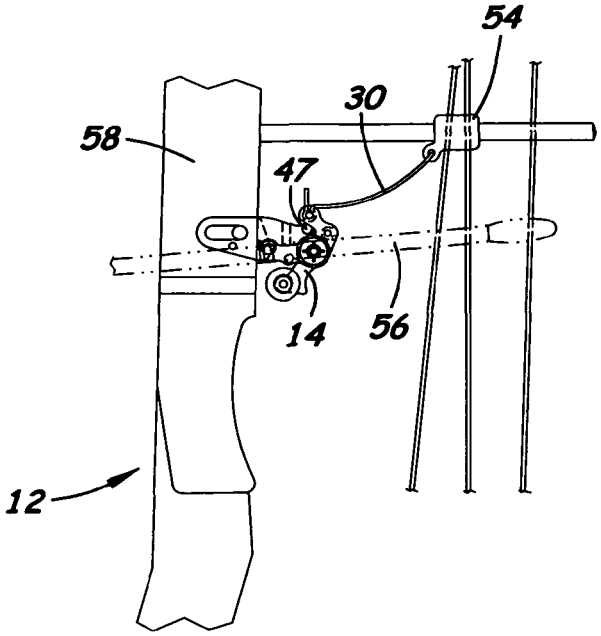
FIG. 7 is a side view of a preferred embodiment of the arrow rest of the subject invention in resting position on a bow.
Figure 8:
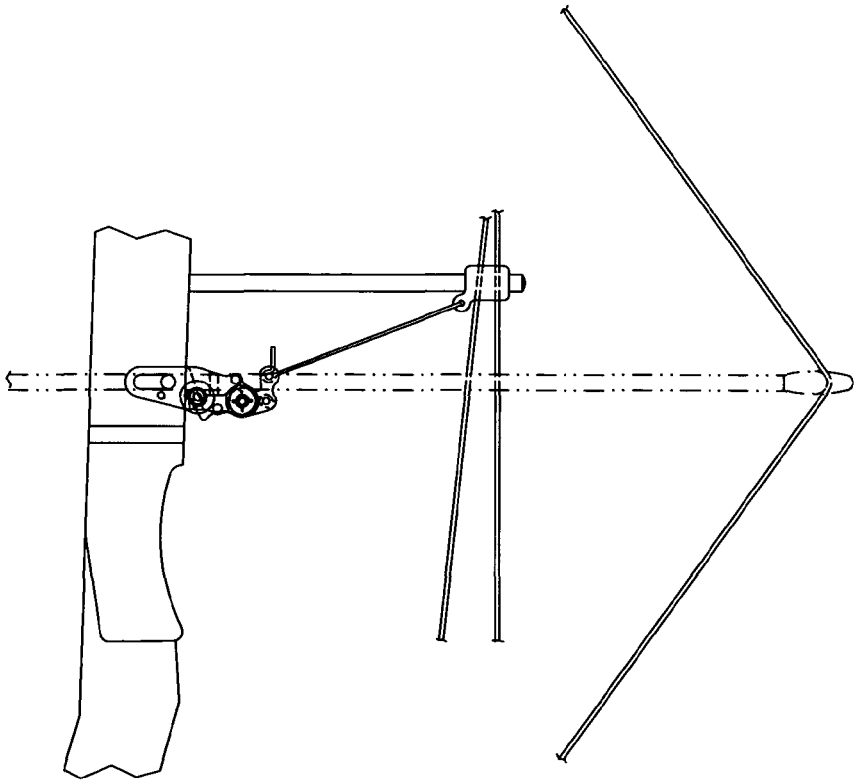
FIG. 8 is a side view of a preferred embodiment of the arrow rest of the subject invention on a drawn bow.
Figure 9:
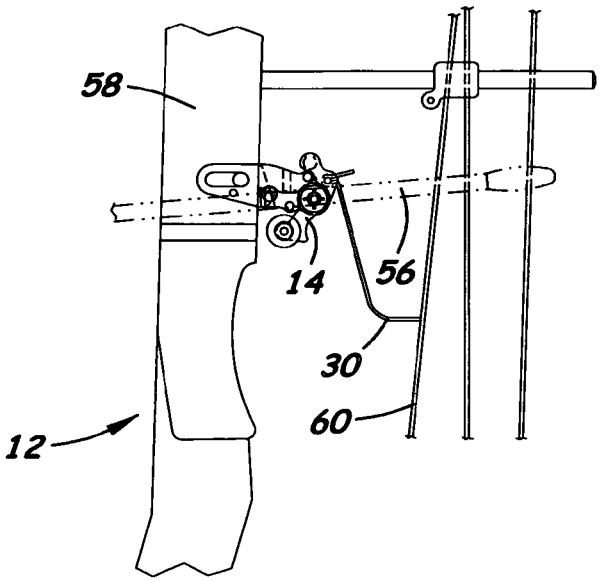
FIG. 9 is a side view of a preferred embodiment of the arrow rest of the subject invention in resting position on a bow, the cord attached to an alternate cord attachment point.
Figure 10:
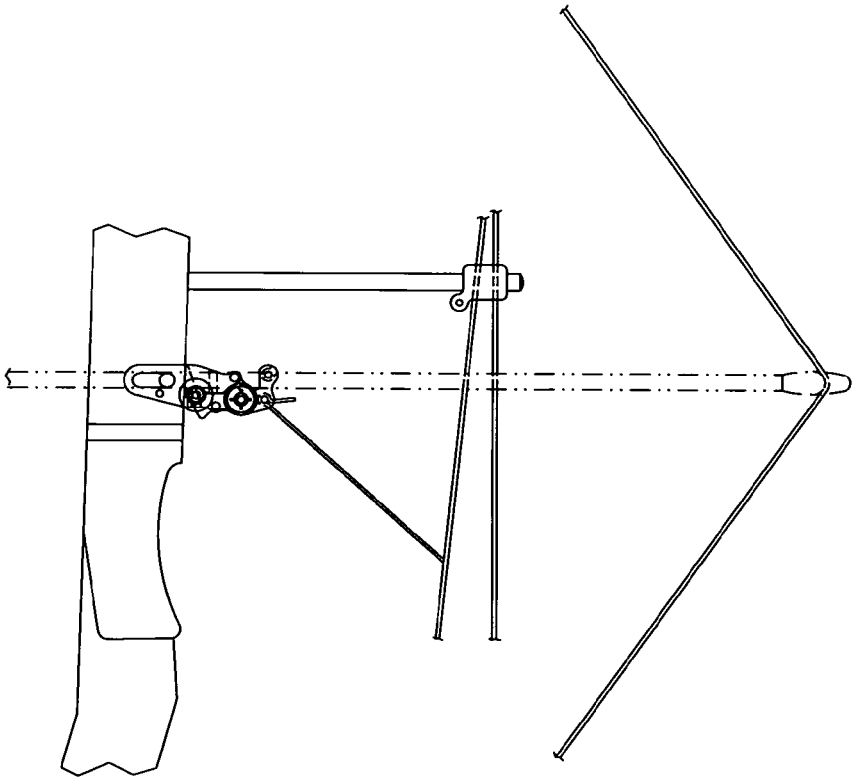
FIG. 10 is a side view of a preferred embodiment of the arrow rest of the subject invention on a drawn bow, the cord attached to an alternate cord attachment point.
Figure 11:
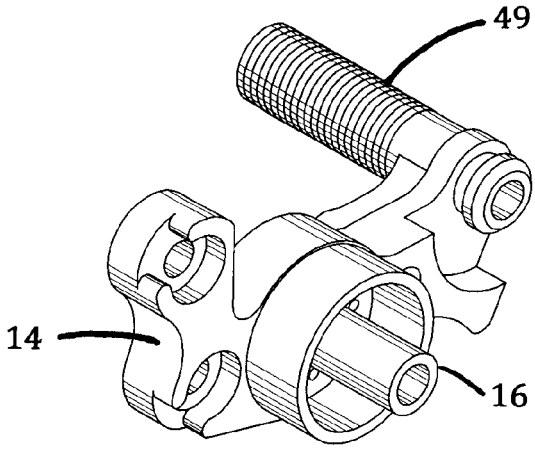
FIG. 11 is a perspective view of a preferred embodiment of a lever of the arrow rest of the subject invention.
Figure 12:
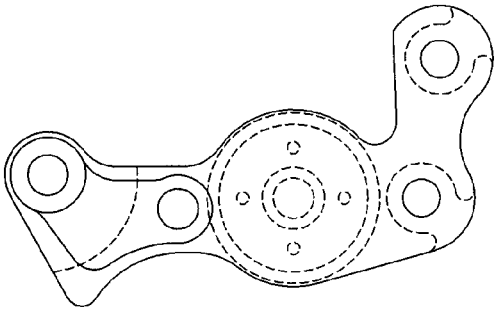
FIG. 12 is a side view of a preferred embodiment of a lever of the arrow rest of the subject invention.
Figure 13:
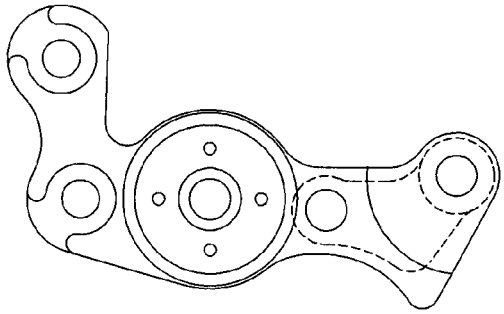
FIG. 13 is an opposite side view of the lever shown in FIG. 12.
Figure 14:
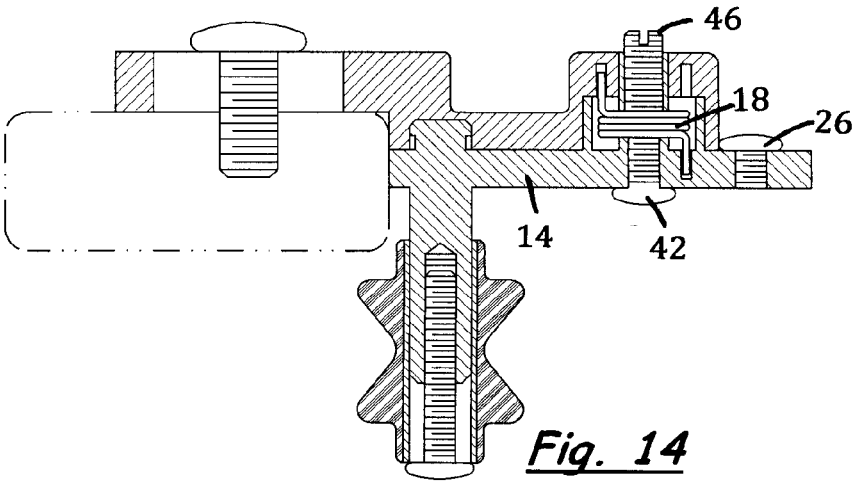
FIG. 14 is a top cross-sectional view of the lever shown in FIG. 11 as part of a preferred embodiment of the arrow rest of the subject invention.

FIG. 7 illustrates the bow in the normal relaxed position with the arrow rest launcher spool 48 at its lowest resting point. The pull cord 30 is attached to the cable slide 54 of the bow for actuating movement of the arrow rest. The arrow 56 is nocked onto the string at a point that is approximately at a 90-degree angle from the string to the center of the arrow rest mounting hole in the bow riser 58. As the bow is fully drawn (FIG. 8), the launcher 48 rises to the full upward travel, and the bow is ready to be fired. As soon as the bow is fired, the pull cord 30 slacks, and the biasing spring returns the launcher to the lowest position so that the arrow passes the launcher unimpeded. FIGS. 9 and 10 show the arrow rest in use with the cord 30 attached to the rest in an alternate cord attachment position 20B and the cord attached to the bow along the cable 60.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. An arrow rest and launcher for an archery bow comprising:

a body to mount the rest to the bow;

a lever arm that moves relative to the body; and a launcher spool extending from the lever arm and away from the body;

wherein the launcher spool has an internally threaded bore that engages external threads of a threaded stud extending from the lever arm, movement of the launcher spool relative to and along the threaded stud allows for incremental adjustment of the distance of the launcher spool from the lever arm, a locking screw engages internal threads of the threaded stud to secure the launcher spool to the stud after adjustment.

2. The arrow rest and launcher of claim 1, wherein said lever arm pivots relative to said body about a post, said body and said lever arm being connected through the post by a screw and an opposing locking screw to allow adjustment of clearance between said lever arm and said body.

3. The arrow rest and launcher of claim 2, wherein said post extends from said body.

4. The arrow rest and launcher of claim 2, wherein said post extends from said lever.

5. The arrow rest and launcher of claim 1, wherein said lever arm is moved relative to said body by a cord attached to said lever arm and a moving part of said bow, the cord attached to said lever arm through at least one cord attachment point comprising a bore to receive a screw in a surface of said lever arm surrounded by a cavity having a sidewall, the cord wrapped around and anchored to said lever arm by the screw and retained by the sidewall.

6. The arrow rest and launcher of claim 5, comprising at least two cord attachment points.

7. The arrow rest and launcher of claim 5, wherein said cord attachment point has at least one opening in said sidewall.

8. An arrow rest and launcher for an archery bow comprising:

a body to mount the rest to the bow;

a lever arm that pivots relative to the body, wherein said lever arm pivots about a post, wherein said post extends from said lever, the body and lever arm being connected through the post by a screw and opposing locking screw to allow adjustment of clearance between the lever arm and the body; and a launcher spool extending from the lever arm and away from the body.

* * * * *